US010906705B2

(12) United States Patent
Ferrari et al.

(10) Patent No.: US 10,906,705 B2
(45) Date of Patent: Feb. 2, 2021

(54) STOPPER FOR A CONTAINER WITH A RECLOSABLE DISPENSER PROVIDING EVIDENCE OF FIRST OPENING

(71) Applicants: Silvia Ferrari, Lodi (IT); Guglielmo Ferrari, Lodi (IT)

(72) Inventors: Silvia Ferrari, Lodi (IT); Guglielmo Ferrari, Lodi (IT)

( * ) Notice: Subject to any disclaimer, the term of this patent is extended or adjusted under 35 U.S.C. 154(b) by 126 days.

(21) Appl. No.: 15/959,216

(22) Filed: Apr. 21, 2018

(65) Prior Publication Data

US 2018/0319551 A1 Nov. 8, 2018

(30) Foreign Application Priority Data

May 5, 2017 (IT) ..... 102017000048753

(51) Int. Cl.

| | |
|---|---|
| ***B65D 41/34*** | (2006.01) |
| ***B65D 47/08*** | (2006.01) |
| ***B65D 47/24*** | (2006.01) |
| *B65D 47/12* | (2006.01) |
| *B65D 59/06* | (2006.01) |

(52) U.S. Cl.

CPC ..... *B65D 41/34* (2013.01); *B65D 47/0804* (2013.01); *B65D 47/242* (2013.01); *B65D 47/128* (2013.01); *B65D 59/06* (2013.01); *B65D 2401/15* (2020.05); *B65D 2401/20* (2020.05)

(58) Field of Classification Search

CPC ..... B65D 41/34; B65D 47/08; B65D 47/24; B65D 47/34; B65D 47/205; B65D 47/243; B65D 55/024; B65D 59/06; B65D 2101/003; B65D 47/0804

See application file for complete search history.

(56) References Cited

U.S. PATENT DOCUMENTS

| | | | | |
|---|---|---|---|---|
| 7,003,813 | B1 * | 2/2006 | Krause | E03D 9/037 4/227.2 |
| 2004/0150221 | A1 * | 8/2004 | Brown | B65D 55/06 283/114 |
| 2014/0360968 | A1 * | 12/2014 | Barth | B65D 41/34 215/44 |
| 2016/0016703 | A1 * | 1/2016 | Muhlemann | B65D 41/62 222/566 |

FOREIGN PATENT DOCUMENTS

| | | | | |
|---|---|---|---|---|
| EP | 1619135 | A1 * | 1/2006 | B65D 51/18 |
| EP | 2332851 | A1 * | 6/2011 | B65D 47/243 |

* cited by examiner

*Primary Examiner* — Anthony D Stashick
(74) *Attorney, Agent, or Firm* — Themis Law

(57) ABSTRACT

A stopper for a container providing evidence of first opening includes an upper part with a protection cap closable on a pouring element and a ridged lower part with an upper hollow cylindrical portion disposed inside the pouring element and a lower cylindrical portion of larger diameter that is internally threaded. A frangible label is positioned between the protection cap, and a security ring is connected with the upper and lower parts with frangible bridges. An annular security crown is connected to the lower part of the stopper by frangible bridges and a cam arrangement, coaxially coupled between an outer surface of the upper hollow cylindrical portion and an inner surface of the pouring element, causes their translation and rotation. The pouring element has a duct passage and a coaxial island shutter which cooperates with a central hole in the upper hollow cylindrical portion of the lower part.

7 Claims, 4 Drawing Sheets

STOPPER FOR A CONTAINER WITH A RECLOSABLE DISPENSER PROVIDING EVIDENCE OF FIRST OPENING

FIELD OF THE INVENTION

The present invention relates to a stopper for a container with a reclosable dispenser with evidence of first opening.

BACKGROUND OF THE INVENTION

Closing stoppers are used on containers for drinks and other liquid products, such as drinks with vitamin supplements, water with additives in general, juices, tea, etc. These closing stoppers provide on their openings a reclosable protective cap with respect to a base collar.

In the first place, this type of closure stopper must allow both an opening and a closing of the same, while ensuring that the internal product is that inserted by the filling company and original.

Secondly, the opening and closing must take place for a certain number of times, without any difficulty in handling, even with just one hand.

In addition, in these stoppers it must be possible to verify with extreme immediacy and simplicity that the container is intact, i.e. that the closure has not been tampered with and a first opening has not already been effected.

Furthermore, stoppers of this type are made up of various pieces, creating problems relating to moulding, assembly and sterilization of the parts when assembled and also the danger of stagnation of washing products in the stopper.

Known stoppers of this kind, moreover, are also arranged on containers of products also containing gas in the liquids and must therefore be able to hold the pressure that is created within them.

Closure stoppers to be screwed on a screw neck of a container of the type with an openable and reclosable protective cap have been designed and produced, which, in order to meet these problems, are extremely complex to construct and have a high number of constituent parts.

It should also be pointed out that there are currently closure stoppers to be screwed onto a screw neck of a container of the type with an openable and reclosable protection cap that have only and simply the possibility of verifying that the entire stopper is positioned without tampering on the neck of the container.

There is on the other hand the requirement of being able to produce a stopper equipped with a cap that provides the possibility of verifying not only that there has been no tampering but also that there is no opening between the protection cap and base collar to which said cap is constrained and articulated.

SUMMARY OF THE INVENTION

An objective of the present invention is therefore to find an adequate and different solution to the technical problems indicated above.

A further objective of the invention is to provide a stopper of the type mentioned above that is capable of revealing any type of tampering.

Another objective of the invention is to provide a stopper which is easy to construct and inexpensive, as well as being particularly simple to use and operate.

Yet another objective of the invention is to provide a stopper of the type mentioned above, which is easy to clean when assembled without the danger of remaining traces of cleaning products.

A further general objective of the present invention is to provide a stopper which is capable of solving the drawbacks of the known art indicated above in an extremely simple, economical and particularly functional manner.

The above objectives are achieved by a stopper for a container with a reclosable dispenser with evidence of first opening produced according to the independent claim 1 and the subsequent subordinate claims.

BRIEF DESCRIPTION OF THE DRAWINGS

The structural and functional characteristics of the present invention and its advantages with respect to the known art will appear even more evident from the following description, referring to the attached schematic drawings which show an embodiment of the invention itself. In the drawings.

DETAILED DESCRIPTION OF EMBODIMENTS OF THE INVENTION

Figure 1:
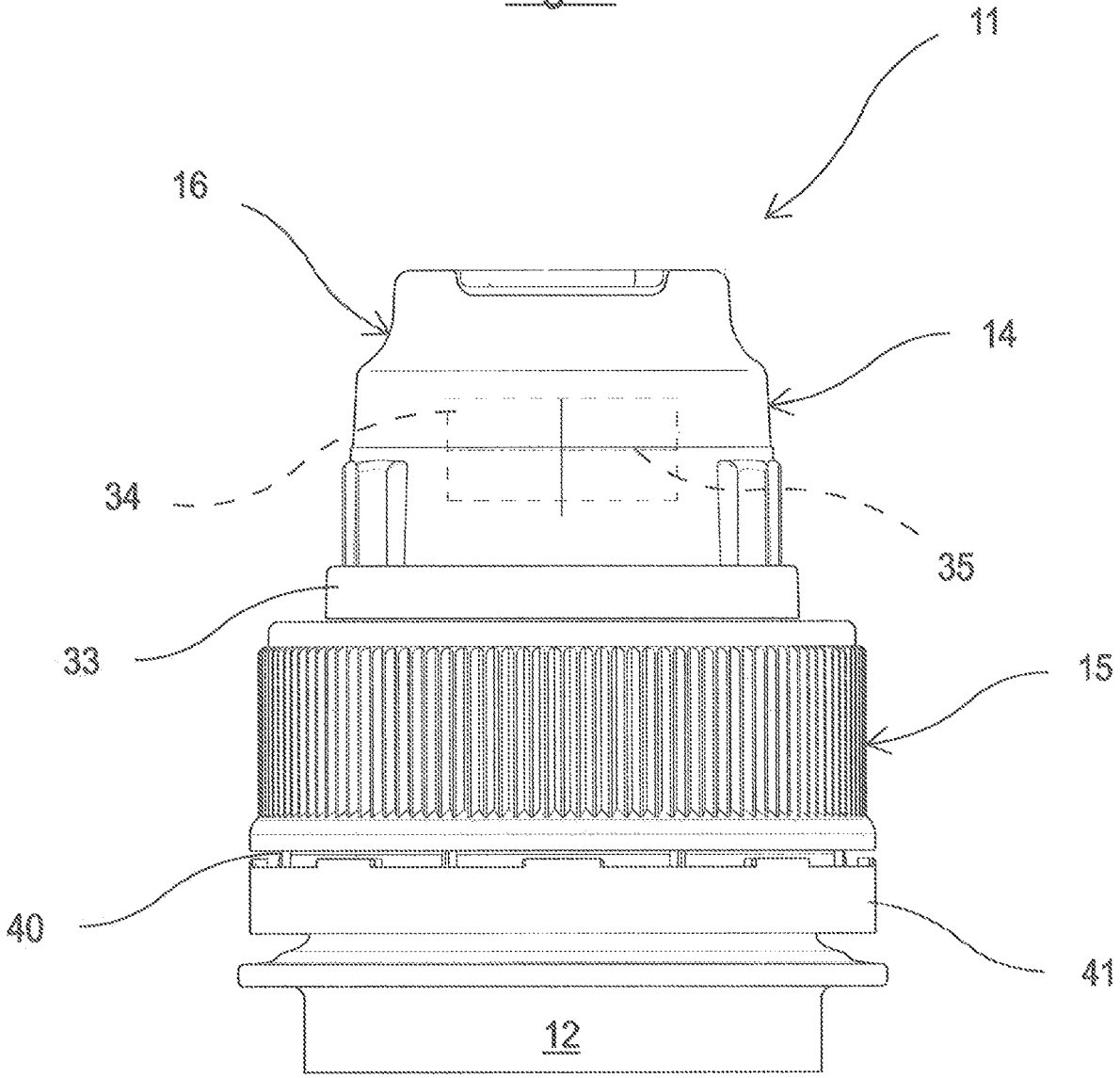
FIG. 1 is a raised view illustrating a stopper according to the present invention when closed and arranged on a mouthpiece of an underlying container, partially shown.
Figure 2:
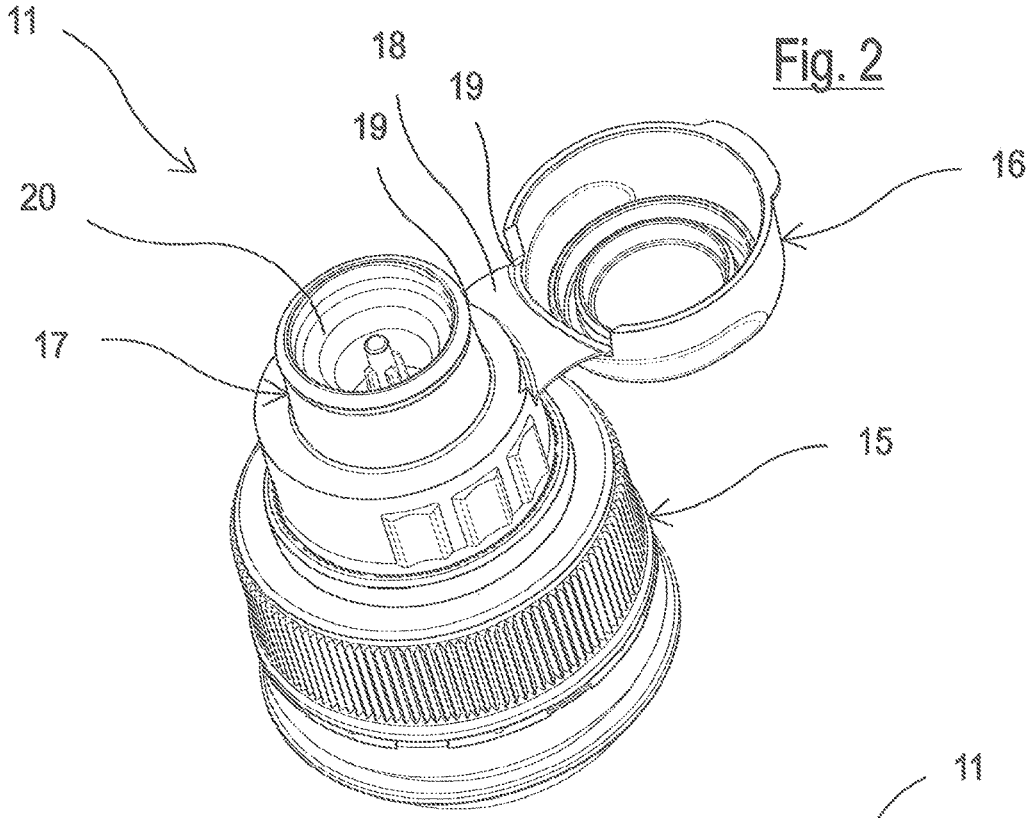
FIG. 2 is a perspective view of the stopper shown in FIG. 1 when open in the protection cap.

With reference to the figures, these show a stopper for a container with a reclosable dispenser with evidence of first opening according to the invention.

The closure stopper 11 is screwed onto a screw neck 12 of a mouthpiece 13 of a container (not shown).

The stopper essentially comprises an upper part 14 and a lower part 15 coupled with each other by snap-assembly.

The upper part 14 which comprises a protection cap 16, is closable on a pouring element 17.

Figure 4:
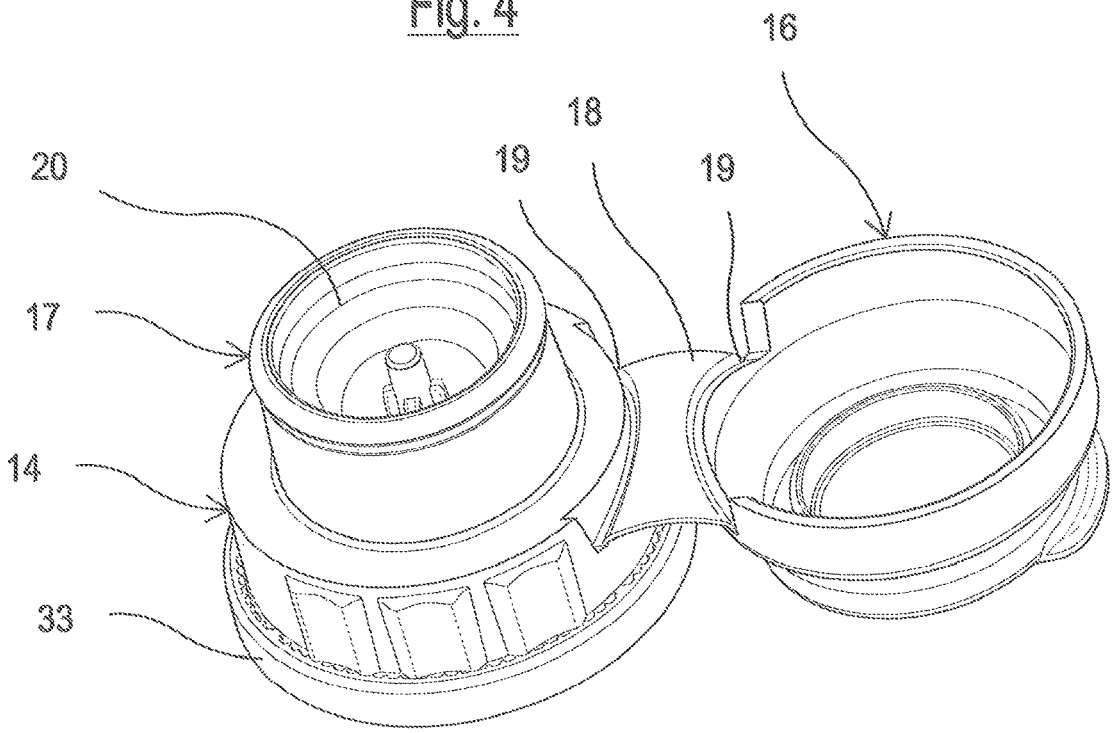
FIGS. 4 and 5 are perspective views of a first upper part and a second lower part of the stopper of FIG. 1 when disengaged and exploded with respect to each other.
Figure 5:
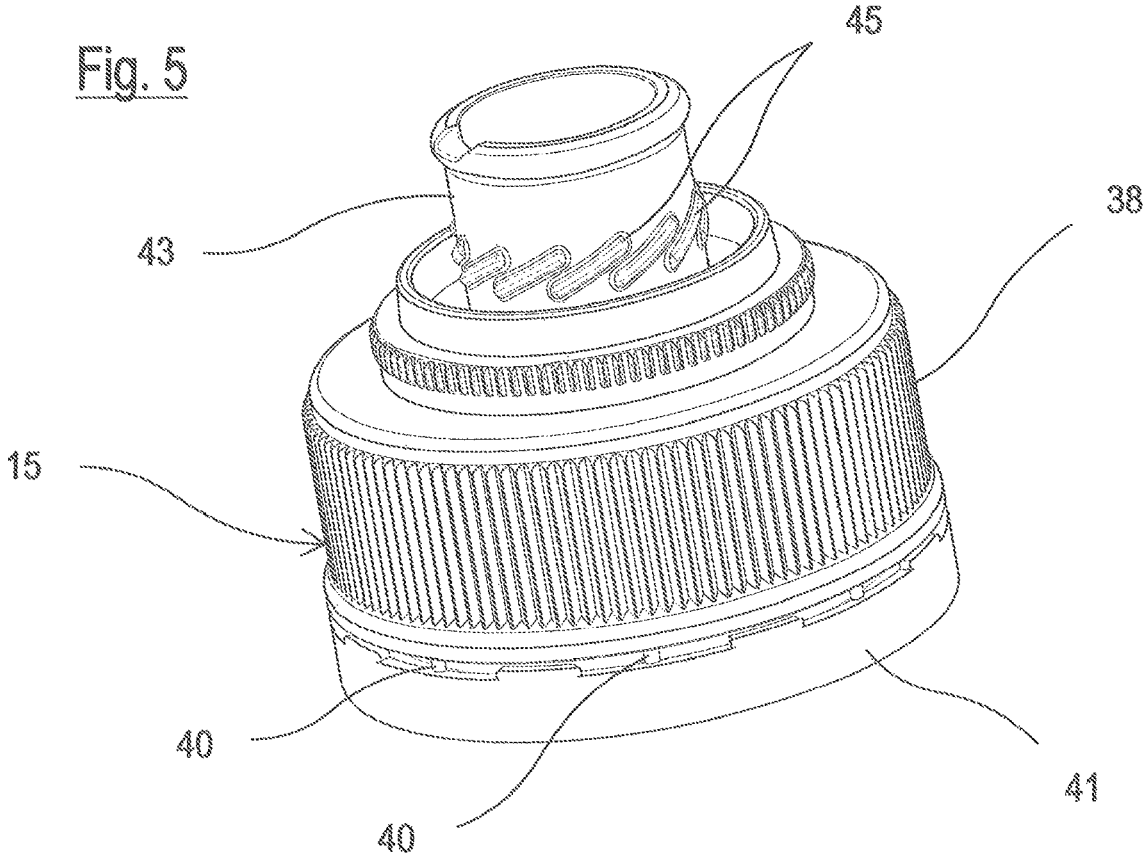
Figure 6:
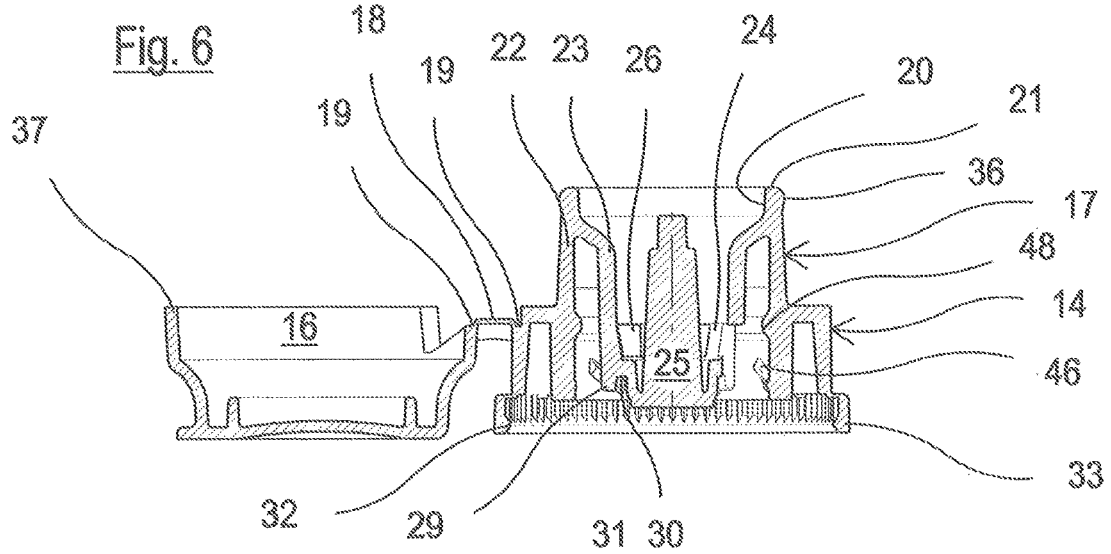
FIGS. 6 and 7 are raised sectional side views of the two parts shown in FIGS. 4 and 5 respectively when they are disengaged and exploded with respect to each other.
Figure 7:
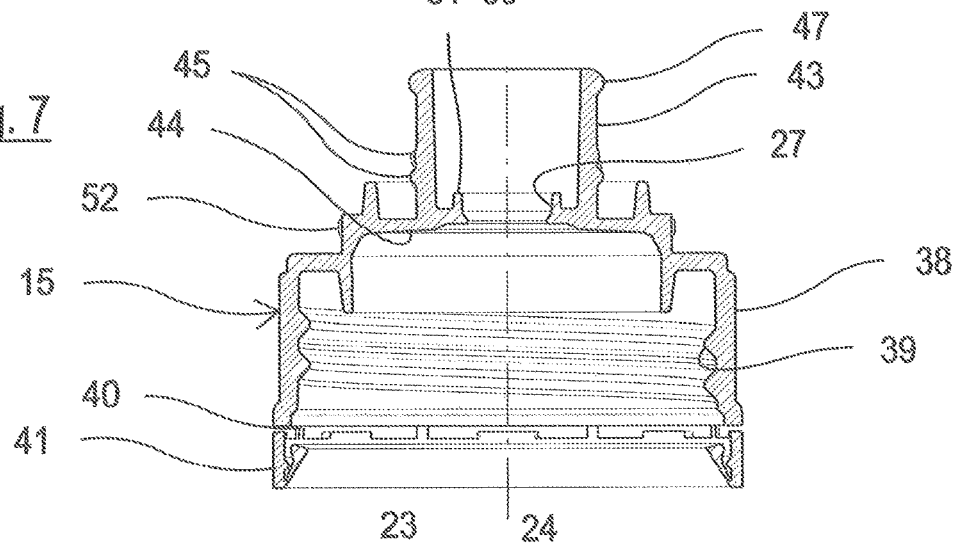

It should be noted that the protection cap 16 and the pouring element 17 are moulded in a single piece, open with respect to each other as shown in FIGS. 4 and 6, and reclosable on each other. The protection cap 16 and the pouring element 17 are stably connected to each other by means of a hinge element 18 consisting of a wide strip. Said hinge 18 also provides a pair of bending invitation lines 19 which favour bending in the opening phase of the protection cap 16 with respect to the pouring element 17 and maintaining this position. The presence of these bending invitation lines 19, in fact, allows the protection cap 16 to be kept open at 180° with respect to the pouring element 17, not disturbing and favouring the supply of liquid in the container towards the user's mouth.

The pouring element 17 provides, above and internally, a duct passage 20 for the outflow of the beverage. Two tubular portions extend downwardly from a top wall 21 of the pouring element 17, one outer 22 and the other inner 23, coaxial, wherein the internal portion 23 is connected by means of bridges 24 to an island shutter 25 coaxial to the same, defining a passage with a plurality of windows 26 towards the duct passage 20.

It should be noted and will be better seen further on that the movement of the upper part 14 effects the closure of the stopper with respect to the lower part 15.

The stopper is closed, in fact, when the upper part 14, sliding with respect to the lower part 15, is completely lowered on the latter causing the island shutter 25 to close a hole 27 defined centrally in the same lower part 15.

It can also be observed that the island shutter 25 is cylindrically shaped and has, externally, in the part facing the hole 27, a wedge-shaped free end 28 which is abutted on the edge of the hole 27. Externally and coaxially to the same, the island shutter 25 extends outwardly with an overturned L-shaped and annular portion 29 which defines, with its cylindrical surface, an annular seat 30 suitable for receiving a shaped annular projection 31 which extends coaxially outside the hole 27 defined centrally in the lower part 15.

The upper part 14 is snap-connected with respect to the lower part 15 by means of an annular projection 32 formed and radially protruding inwardly in the lower end of the pouring element 17 in a security ring 33 of the same. In this way, the pouring element 17 of the upper part 14 in its lower end provides a security ring 33 connected to it by means of frangible bridges 53 and separable from it with the first use of the stopper, having been previously snap-connected by means of the annular projection 32 to a radial flap 52 radially protruding outwardly, provided in the lower part 15.

Characteristically according to the invention, a label 34 is also applied astride between the protection cap 16 and the outer wall of the pouring element 17, when the protection cap 16 is closed on the pouring element 17, once the automatic assembly of the two parts 14, 15 of the stopper has been completed. Said label 34, of the breakable type with the first opening by means of a breakage invitation line 35, can be limited to a small area between the protection cap 16 and pouring element 17 (as shown in FIG. 1) or it can be astride between opposite parts of the entire stopper in the form of an overturned U above it.

The top wall 21 of the pouring element 17 also has an annular extension towards the outside 36 which is suitable for snap-receiving an internal wall 37 of the protection cap 16 so as to obtain complete coverage of the pouring element 17 with respect to the outside.

The lower part 15 is produced with a section having cylindrical steps with diameters decreasing upwardly, where it is coupled with the upper part 14. The lower part 15, through a first lower cylindrical portion having a larger diameter 38, internally threaded in 39, is to be positioned on a screw neck 12 of a mouthpiece 13 of a container.

This first portion with a larger diameter 38 extends, in a lower end, by means of frangible bridges 40 into an annular security crown 41 which is positioned below a radial annular projection towards the outside 42 of the screw neck 12.

An appendage or upper hollow cylindrical portion 43, having a smaller diameter, extends coaxially upwards from the first portion having a larger diameter 38 of the lower part 15 of the stopper, said appendage providing the above-mentioned central hole 27 and being coaxially coupled with the pouring element 17. The central hole 27 is produced in an upper wall 44 of the first portion having a larger diameter 38 of the lower part 15 in an area having a stepped profile.

Figure 3:
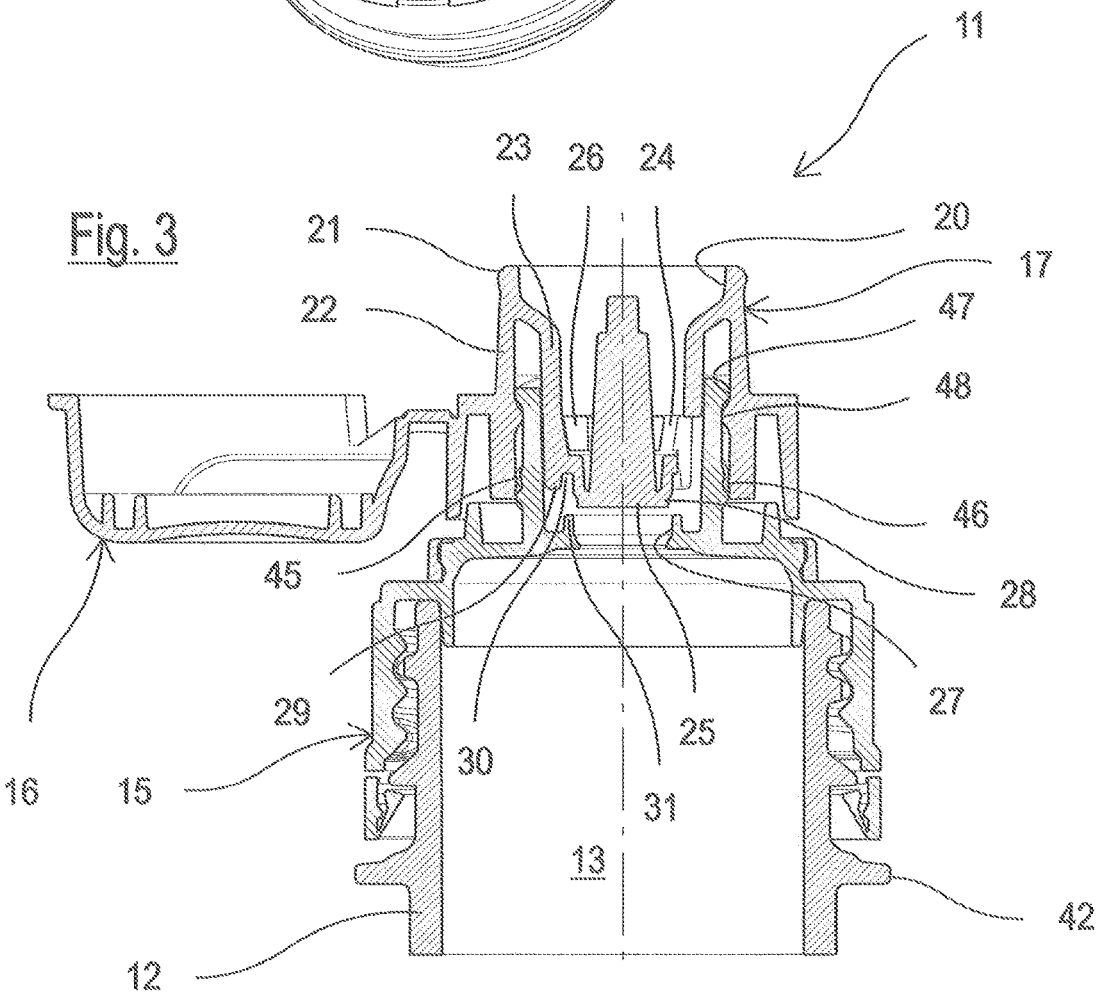
FIG. 3 is a raised sectional side view of the open stopper shown in FIG. 2, applied to a mouthpiece of an underlying container, partially shown.
Figure 8:
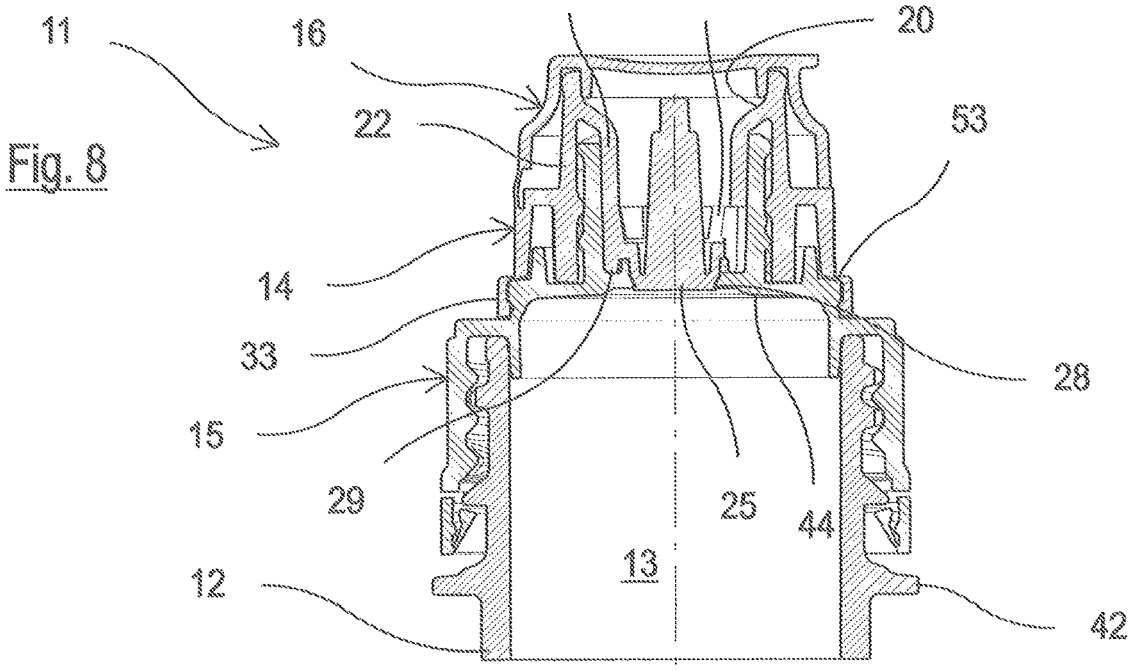
FIG. 8 is a sectional view of the stopper of FIG. 1 in a raised side view.

It should also be pointed out that, on the outer surface of the upper hollow cylindrical portion 43, there is a series of helical grooves 45, spaced apart and parallel to each other, protruding outwardly, which extend for a short distance of said outer surface. Complementarily, the inner surface of the outer tubular portion 22 of the pouring element 17, which is positioned facing the hollow cylindrical portion 43, provides a series of helical grooves 46, spaced apart and parallel to each other, protruding inwardly. The coupling of the series of helical grooves 45 of the upper hollow cylindrical portion 43 with the series of helical grooves 46 of the outer tubular portion 22 of the pouring element 17 forces the pouring element 17 (or rather the upper part 14 of the stopper) to rotate, when moved. This occurs, in fact, when the upper part 14 of the stopper or the pouring element 17 is moved from the lowered position (FIG. 8) to the raised position (FIG. 3).

An arrangement is also provided for limiting the lifting and/or lowering run of the pouring element 17. A free upper end of the hollow cylindrical portion 43, in fact, provides an outwardly radial run-end annular extension 47 which collaborates with an annular ridge 48 formed on an internal wall of the outer tubular portion 22 of the pouring element 17.

The collaboration between the annular extension 47 and the annular ridge 48 defines the space of the lowering and lifting run of the first upper lower part 14 with respect to the lower part 15 of the stopper.

It should be remembered that the above-mentioned rotation between the upper part 14 and the lower part 15 causes the upper part 14 of the stopper with the pouring element 17 to rise upwards causing the disengagement of the island shutter 25 from the hole 27 and allowing the outflow of the liquid inside the container.

A cam arrangement is thus created with the series of helical grooves 45, 46 which, by rotation and translation of the parts, causes both the dispensing of the drink and also the regulation of the desired quantity of beverage.

A simple rotation and translation in the opposite direction causes the descent of the upper part 14 of the stopper with the pouring element 17 and the engagement of the island shutter 25 to close the hole 27.

It should be noted that in this position, the lower surface of the island shutter 25 is flush with the upper wall 44 of the first portion having a larger diameter 38 of the lower part 15 in which the hole 27 is formed. This alignment produces a flat surface, free of hollows or recesses in which deposits of washing and sanitization products of the stopper used after its assembly could be housed. A stopper of this kind is therefore particularly suitable for a nebulization wash as it is free of areas for the possible deposit of detergent and sanitizing product.

It should also be observed that the overturned L-shaped and annular portion 29 of the island shutter 25, when placed on the annular shaped projection 31 provided around the hole 27, creates a labyrinth seal which guarantees the optimal and safe sealing of the stopper. This arrangement also allows a carbonated beverage to be contained in the container with a stopper according to the invention, even at pressures of 10-12 bars, without any problem of leakage of the beverage, creating a good pressure seal.

It should also be noted that the stopper has an optimum security against tampering and undesired openings. As shown in fact, it is provided with a first security obtained with the label 34 which reveals each first opening between the protection cap 16 and pouring element 17. It also has a second security produced by a security ring 33 positioned between the first upper part 14 and the second lower part 15 which reveals each first opening by lifting between the parts to release the drink.

Finally, a third security is provided, positioned between the two parts 14, 15 of the whole stopper and the screw neck 12 of the mouthpiece 13 of the container produced by the annular security crown 41 which is positioned below the radial annular projection towards the outside 42 of the screw neck 12.

As has been seen, and is repeated, the lower surface of the island shutter 25 arranged flush with the upper wall 44 of the first portion having a larger diameter 38 of the lower part 15 in which the hole 27 is formed, causes a perfect alignment between the parts and creates a flat surface, free of hollows or recesses, which makes the stopper particularly suitable for being sterilized and sanitized by nebulization.

All of the objectives mentioned in the presentation of the prior art indicated in the preamble of the description, have therefore been achieved.

The forms of the structure for producing a stopper of the invention, as also the materials and assembly modes, can naturally differ from those shown for purely illustrative and non-limiting purposes in the drawings.

The protection scope of the present invention is defined by the enclosed claims.

The invention claimed is:

1. A stopper for a container with a closable dispenser providing evidence of first opening, comprising:

an upper part; and a lower part coupled to the upper part by snap-assembly, wherein:

the upper part comprises a protection cap closable on a pouring element and connected thereto by a hinge, the lower part has a section with cylindrical steps having upwardly decreasing diameters, the lower part further having an upper hollow cylindrical portion, which is coaxially coupled inside said pouring element, and a lower cylindrical portion having a larger diameter and internally threaded to be positioned on a screw neck of a mouthpiece of the container, a frangible label is positioned between the protection cap closed on the pouring element, a security ring is positioned between said upper part and said lower part and connected with frangible bridges, an annular security crown is connected to said lower part of the stopper with frangible bridges and positioned between said lower part of the stopper and said screw neck of the container, a cam arrangement is provided between an outer surface of said upper hollow cylindrical portion and an inner surface of said pouring element, coaxially coupled for causing their translation and rotation, said pouring element comprises an outer wall and an inner wall coaxial thereto, said inner wall being longitudinally shorter than said outer wall and merging with said outer wall before an upper end of said pouring element so as to maximize an inner diameter of said pouring element at said upper end, said pouring element internally provides a duct passage and a coaxial island shutter, which cooperates with a hole defined centrally in the upper hollow cylindrical portion of the lower part, a first ring wall is attached to the outer wall of the pouring element and is coaxial thereto, so as to define a gap being between the outer wall and the first ring wall, a second ring wall extending upwardly from the lower part and penetrating the gap, the protection cap being attached to the first ring wall with the hinge, the frangible label provides an invitation line for breakage, and the security ring is attached to the first ring wall and includes an annular projection radially protruding inwardly, which cooperates with a radial flap radially protruding outwardly the said lower part.

2. The stopper according to claim 1, wherein said hole is surrounded by an annular projection, which extends coaxially into said upper hollow cylindrical portion toward said island shutter, which extends outwardly from said inner wall with an overturned L-shaped and annular portion, which defines an annular seat for receiving said annular projection surrounding the hole, thereby creating a labyrinth seal.

3. The stopper according to claim 1, wherein said cam arrangement comprises a plurality of helical grooves, spaced apart and parallel to each other, protruding outwardly and formed, on one side, on an outer surface of said upper hollow cylindrical portion, and on another side, on an internal surface of said pouring element.

4. The stopper according to claim 3, wherein said upper hollow cylindrical portion provides an outwardly radial run-end annular extension, which cooperates with an annular ridge formed on an internal wall of the pouring element.

5. The stopper according to claim 4, wherein said outwardly radial run-end annular extension and said annular ridge define a space for a lowering and lifting run of said upper part with respect to said lower part of the stopper.

6. The stopper according to claim 2, wherein said outer wall extends downwardly from a top wall of the pouring element, and wherein the inner wall is connected with bridges to said island shutter coaxially thereto, defining a passage with a plurality of windows towards the duct passage.

7. The stopper according to claim 2, wherein said island shutter, when completely inserted in said hole of the upper hollow cylindrical portion of the lower part, creates an alignment between the upper and the lower parts and forms a flat surface, free of hollows or recesses.

* * * * *